US007023395B2

(12) United States Patent
Ohara et al.

(10) Patent No.: US 7,023,395 B2
(45) Date of Patent: Apr. 4, 2006

(54) ANTENNA AND COMMUNICATION SYSTEM USING THE SAME

(75) Inventors: Masahiro Ohara, Osaka (JP); Shinji Kamaeguchi, Osaka (JP); Toru Arakawa, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 35 days.

(21) Appl. No.: 10/823,633

(22) Filed: Apr. 14, 2004

(65) Prior Publication Data

US 2005/0030243 A1 Feb. 10, 2005

(30) Foreign Application Priority Data

Aug. 5, 2003 (JP) ..... 2003-286676

(51) Int. Cl.
*H01Q 7/08* (2006.01)

(52) U.S. Cl. ..... 343/788; 343/787

(58) Field of Classification Search ..... 343/713, 343/787, 788

See application file for complete search history.

(56) References Cited

U.S. PATENT DOCUMENTS

| | | | | |
|---|---|---|---|---|
| 4,978,966 | A * | 12/1990 | Takizawa et al. | 343/788 |
| 5,408,243 | A * | 4/1995 | D'Hont | 343/718 |
| 6,249,259 | B1 * | 6/2001 | Goodman et al. | 343/788 |
| 6,400,330 | B1 * | 6/2002 | Maruyama et al. | 343/788 |
| 2003/0107523 | A1 * | 6/2003 | Yahata et al. | 343/787 |
| 2004/0061660 | A1 * | 4/2004 | Yoshida et al. | 343/788 |

FOREIGN PATENT DOCUMENTS

| | | |
|---|---|---|
| JP | 10-341105 | 12/1998 |

* cited by examiner

*Primary Examiner*—Tho Phan
(74) *Attorney, Agent, or Firm*—Wenderoth, Lind & Ponack, L.L.P.

(57) ABSTRACT

An antenna includes a first core made of magnetic material, a coil including a conductive wire wound around a predetermined region of the first core, and a second core made of magnetic material. The second core is operable to move an inside of the coil. The antenna has a resonant frequency adjustable over a wide rage.

30 Claims, 5 Drawing Sheets

ANTENNA AND COMMUNICATION SYSTEM USING THE SAME

FIELD OF THE INVENTION

The present invention relates to an antenna and a communication system using the antenna.

BACKGROUND OF THE INVENTION

Vehicles recently include a communication system used for locking and unlocking a door of the vehicle through a remote controlling operation through an antenna mounted to the vehicle.

A conventional antenna for the above purpose will be explained.

FIG. 6 is a perspective view of the conventional antenna 100. A core 1 having a rectangular column shape is made of magnetic material of Ni ferrite and a coil 2 of metal wire, such as copper wire, is coated with heat-resistant resin and is wound a specific number of times on a predetermined region of the outer surface of the core 2. A screw 3 made of Ni ferrite magnetic material is inserted into a screw hole provided at an outside of the coil 2 on the core 1 as to move forward and backward by rotation of the screw. A wiring board 4 has patterns of wiring (not shown) provided on both, upper and lower, surfaces thereof. The wiring board 4 is mounted to the bottom of a recess 5A provided in case 5 made of heat-resistive resin. The wiring patterns are soldered to both ends of the coil 2. Electronic components 6, such as a capacitor 6A and a resistor 6B, are mounted on the wiring board 4 and electrically connected to the coil 2 by the wiring patterns, thus providing a series-resonant circuit.

The conventional antenna 100 having the foregoing arrangement may however have a varying resonant frequency since a capacitance of the capacitor 6A, a resistance of the resistor 6B, and an inductance of the coil 2 may vary.

When a coil moves close to magnetic material, a magnetic flux profile generally varies, thus changing the inductance accordingly.

According to the above principle, the screw 3 of magnetic material can move towards and from the coil 2 for changing the inductance of the coil 2, thus adjusting the resonant frequency of the antenna 100 to a desired frequency.

The series resonant circuit including the antenna 100 is electrically connected through the wiring patterns to an electronic circuit (not shown) of an internal communication device mounted to a door or a mirror of the vehicle, hence providing a communication system.

When a driver of the vehicle carrying a mobile card as an external communication device moves close to the vehicle or transmits radio waves from a mobile telephone as the external communication device, the antenna 100 receives a signal corresponding to the above operations. An identification code of the external communication device is then examined by the electronic circuit of the internal communication device for locking and unlocking the door.

An antenna having an adjustable resonant frequency is disclosed in Japanese Patent Laid-Open Publication No.10-341105.

SUMMARY OF THE INVENTION

An antenna includes a first core made of magnetic material, a coil including a conductive wire wound around a predetermined region of the first core, and a second core made of magnetic material. The second coil is operable to move at an inside of the coil.

The antenna has a resonant frequency adjustable in a wide range.

DETAILED DESCRIPTION OF THE PREFERRED EMBODIMENT

Figure 6:
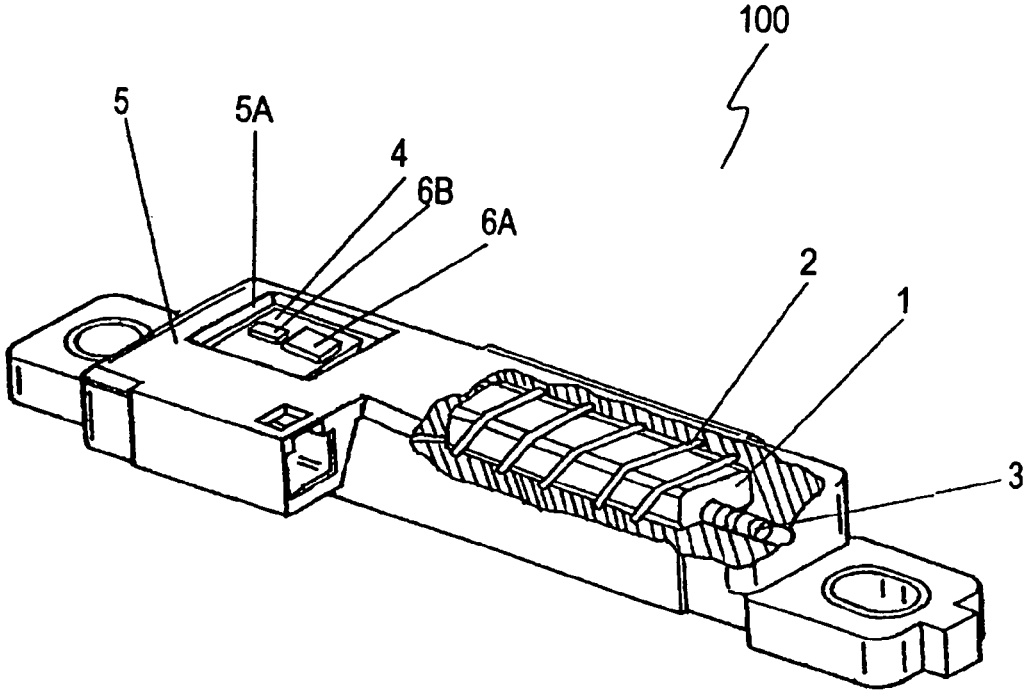
Fig. 6 PRIOR ART
FIG. 6 is a perspective view of a conventional antenna.

A conventional antenna 100 shown in FIG. 6 has the following disadvantages. As explained, a coil has a magnetic flux change when approaching to magnetic material. An inductance of the coil changes according to a change of a density of the magnetic flux. An amount of the change of the inductance increases when the magnetic material approaches to a region where the density of the magnetic flux is high. The density of the magnetic flux at an inside of the coil is higher than that at the outside of the coil. In the antenna 100, a screw 4 moves at the outside of the coil 2, that is, at a region where the density of the magnetic flux is low to adjust a resonant frequency. Therefore, the inductance of the coil 2 can be changed a little, hence allowing the resonant frequency to be adjusted within a small range or not to be adjusted.

Figure 1:
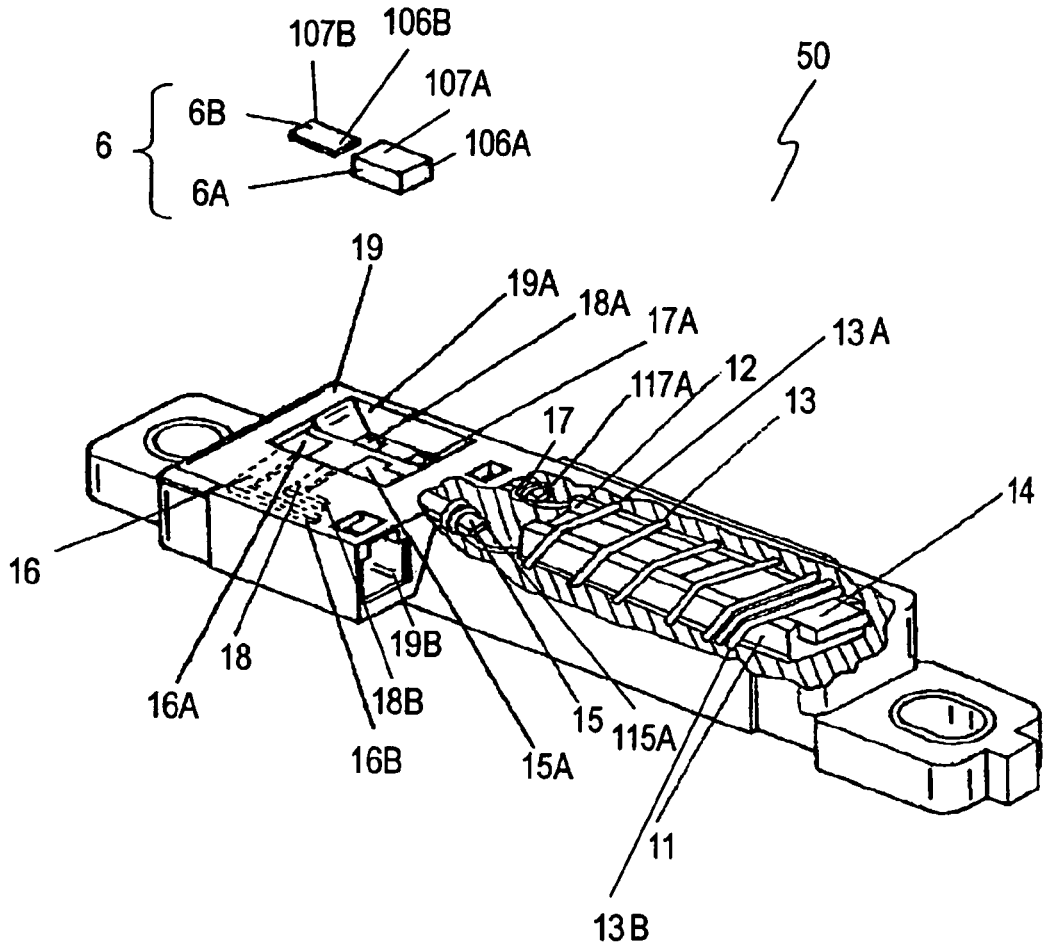
FIG. 1 is a perspective view of an antenna of an exemplary embodiment of the present invention.

FIG. 1 is a perspective view of an antenna 50 according to an exemplary embodiment of the present invention. A core 11 having a polygonal column shape is made of magnetic material, such as Ni ferrite, having a magnetic permeability of about 1600. The core 11 has a recess 12 provided therein in a longitudinal direction of the core 11 substantially at a center of an upper surface of the core 11. A coil 13 is made of a conductive, metal wire, such as copper wire, coated with heat-resistant resin, such as polyimide. The metal wire is wound from one end 13A to the other end 13B over the surfaces of the core 11. In the coil 13, the wire is wound at the end 13B by an interval narrower than that at the other region, i.e., the wire is wound at the end 13B in the number of turns greater than that at the other region. An auxiliary core 14 having a polygonal shape is made of magnetic material, such as Mn ferrite, having a magnetic permeability of about 4000. The auxiliary core 14 is inserted at the recess 12 of the core 11 from the end 13B where the coil 13 is wound at the narrower interval, and is coated with a sealer made of material, such as silicone, for fixing the core 14 inside of the coil 13.

Conductive strips 15 to 18 having sheet shapes, made of material such as copper alloy, are provided and embedded by insert molding in a case 19 made of heat-resistant resin such as liquid crystal polymer or poly butylene terephthalate. The conductive strip 15 has an end 115A connected to the coil 13 by high-temperature soldering or swage locking. The conductive strip 15 has an electrode 15A provided at the other end of the strip 15. The electrode 15A is exposed at a bottom of a recess 19A provided in the case 19. A resistor 6B has an end 106B connected on the electrode 15A with, e.g. solder paste. The conductive strip 16 has an electrode 16A provided at an end of the strip 16, and the electrode 16A is exposed at the bottom of the recess 9A. The other end 107B of the resistor 6B is connected on the electrode 16A. The conductive strip 16 has a connector 16B provided at the other end of the strip 16 and projecting into a tubular region 19B of the case 19. The conductive strip 17 has an end 117A connected to the other end of the coil 13. A capacitor 6A has an end 106A connected to an electrode 17A of the conductive strip 17. The conductive strip 18 has an electrode 18A provided at an end of the strip 18. The electrode 18A is connected to the other end 107A of the capacitor 6A. The conductive strip 18 has a connector 18B provided at the other end of the strip 18 and projecting into the tubular region 19B of the case 19. The conductive strips 15 to 18 may have their surfaces plated with, e.g., tin for easy connection to the electronic components 6 including the capacitor 6A and the resistor 6B.

Figure 2:
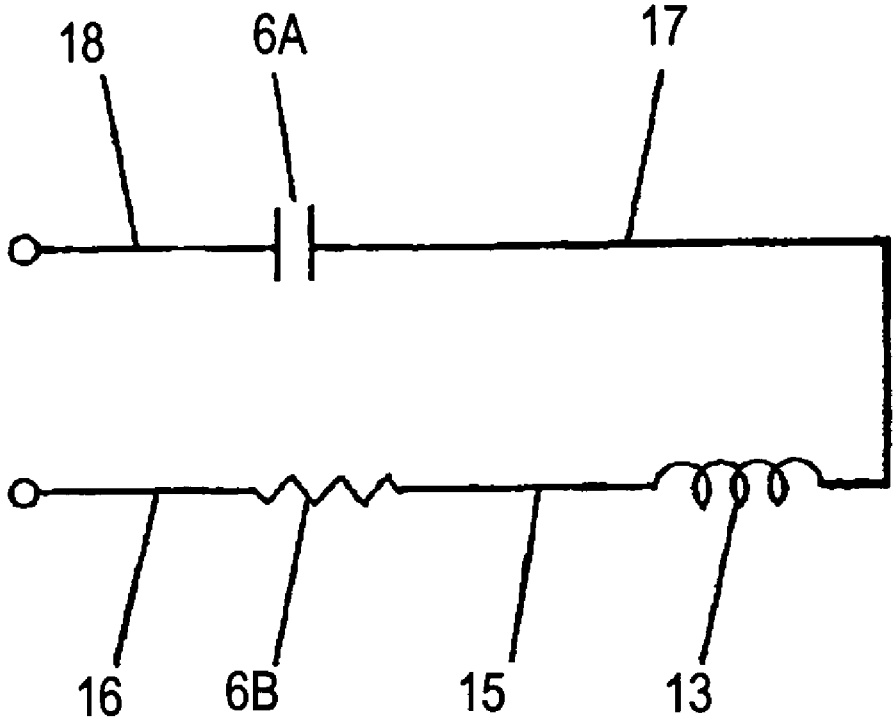
FIG. 2 is a circuitry diagram of the antenna of the embodiment.

FIG. 2 is a circuit diagram of the antenna 50 of the embodiment. The coil 13 has the one end connected to the resistor 6B via the conductive strip 15 and has the other end connected to the capacitor 6A via the conductive strip 17, hence providing a series resonant circuit. The antenna 50 having the foregoing arrangement may have a resonant frequency vary since a capacitance of the capacitor 6A, a resistance of the resistor 6B, and an inductance of the coil 13 may change.

A coil approaches to magnetic material, and generally, a density of a magnetic flux passing through the coil accordingly varies, thus allowing the coil to have an inductance changes. The change of the inductance increases when the magnetic material approaches to a region where the density of the magnetic flux is high. The density of the magnetic flux at an inside of the coil is higher than that at the outside of the coil. Inside of the coil, the density of the magnetic flux at a region where a wire is wound at a small interval is higher than the density at a region where the wire is would at a large interval. P33594

Based on the above principle, the resonant frequency of the antenna 50 can be adjusted to be a desired frequency by moving the auxiliary core 14 made of magnetic material in the recess 12 of the coil 13.

Since the auxiliary core 14 moves within the inside of the coil, that is, the region where the density of the magnetic flux density is high, the core 14 allows the inductance of the coil 13 to change more than that of the coil 2 of the conventional antenna 100 shown in FIG. 6.

The auxiliary core 14 moves from the end 13B of the coil 13 where the coil 13 is wound at a smaller interval. This causes the inductance of the coil 13 to change faster and greater than in the case in which the auxiliary core 14 moves from the end 13A where the coil 13 is wound at an equal interval. Accordingly, the antenna 50 of the embodiment has a resonant frequency adjustable within a wide range for a short time.

Figure 3:
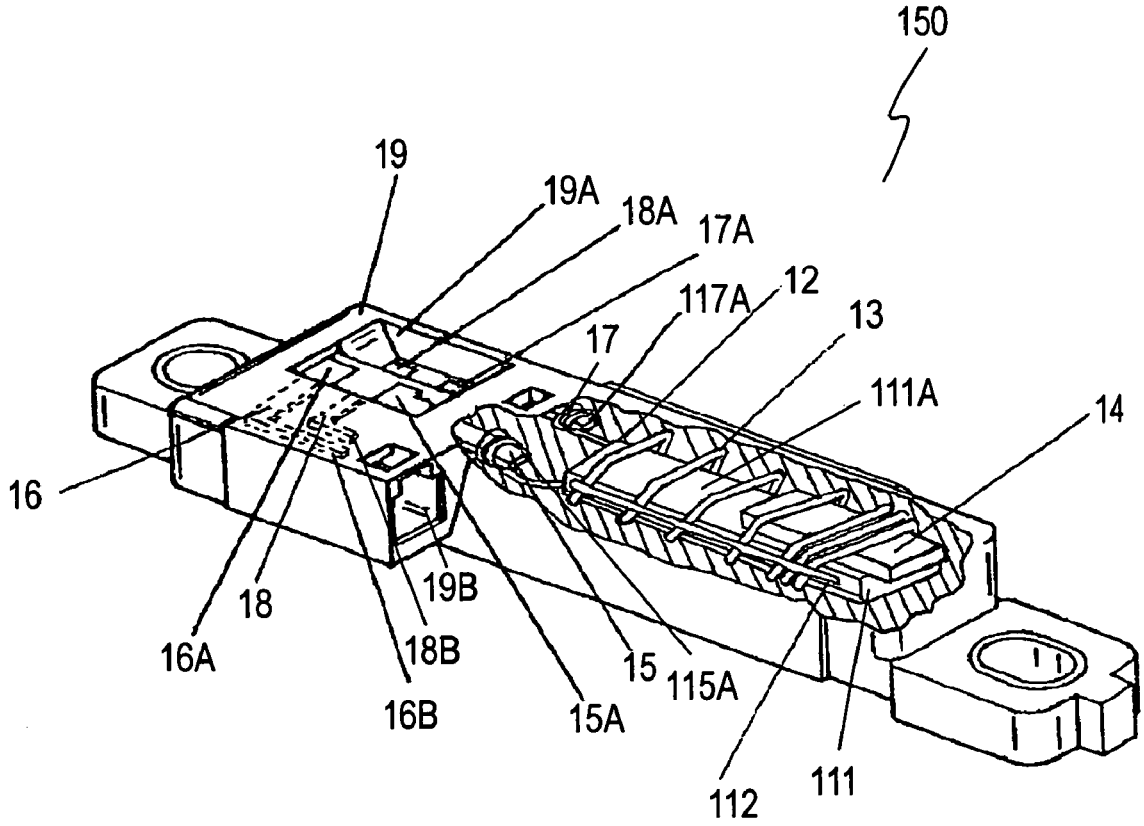
FIG. 3 is a perspective view of another antenna of the embodiment.

FIG. 3 is a perspective view of another antenna 150 of the embodiment. As shown in FIG. 3, the antenna 150 includes a core 111 which does not have a recess formed therein instead of the core 11 having the recess 12 shown in FIG. 1. The coil 13 is fixed on a side of the core 111 with an adhesive 112. The auxiliary core 14 moves on an upper surface 111A.

Figure 4:
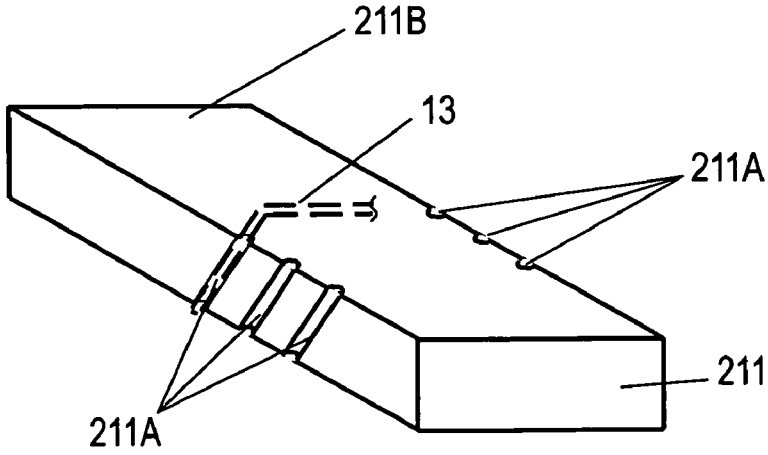
FIG. 4 is a perspective view of a core of a further antenna of the embodiment.

FIG. 4 is a perspective view of a core of a further antenna of the embodiment. The coil 13 is fixed on a side of the core 111 shown in FIG. 3 with an adhesive 112. As shown in FIG. 4, a core 211 may have recesses 211A formed therein to fix the coil 13 in the recesses 211A. The auxiliary core 14 moves on an upper surface 211B of the core 211.

However, the core 11 having the recess 12 shown in FIG. 1 does not require the adhesive 112 shown in FIG. 3 or the recesses 211A shown in FIG. 4, and hence the coil 13 can be fixed around the core 11 easily.

Figure 5:
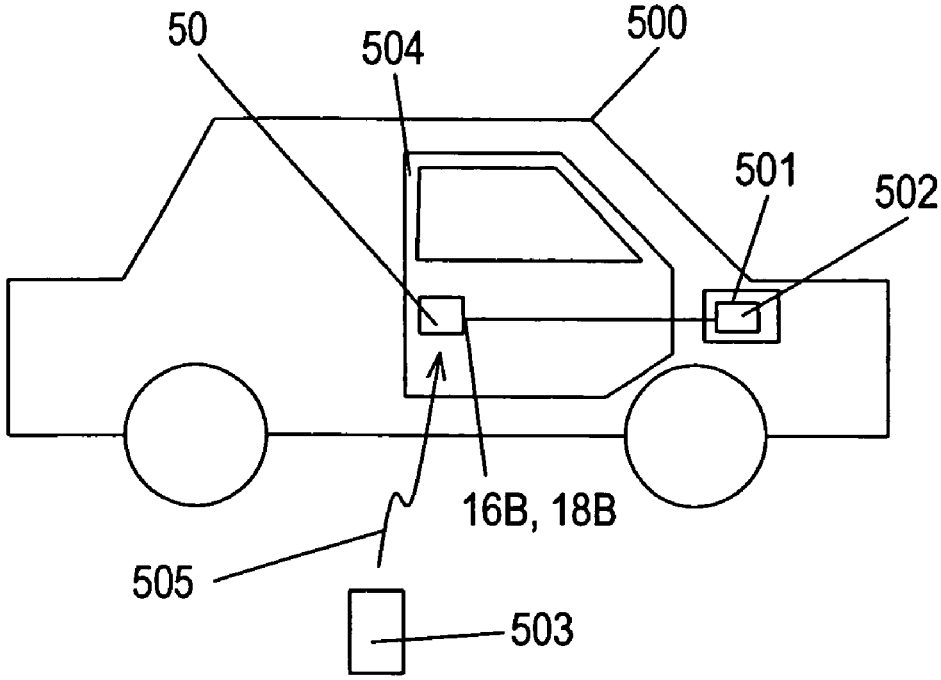
FIG. 5 is a schematic view of a communication system including the antenna of the embodiment.

FIG. 5 is a schematic view of a communication system employing the antenna 50. The case 19 of the antenna 50 is mounted to a door 504 or a mirror of a vehicle 500. The connectors 16B and 18B extending from the tubular region 19B of the case 19 are electrically connected to an electronic circuit 502 of an internal communication device 501 in the vehicle 500.

When a driver of the vehicle 500 carrying a mobile card as an external communication device 503 approaches to the vehicle 500, a signal 505 transmitted from the external communication device 503 is received by the antenna 50. Then, the electronic circuit 502 compares an identification code of the external communication device 503 with an identification code of the internal communication device 501, and unlocks the door 504. The communication system includes mainly the antenna 50, the internal communication device 501, and the external communication device 503.

According to the embodiment, the auxiliary core 14 is made of magnetic material of Mn ferrite. The magnetic material of Mn ferrite has a magnetic permeability larger than that of magnetic material of Ni ferrite, hence affecting a magnetic field more. Accordingly, the auxiliary core 14 can change the inductance of the coil 13 more, thus enabling the resonant frequency to be adjusted in a wide range. However, the auxiliary core 14 may be made of Ni ferrite similarly to the core 11.

According to the embodiment, the auxiliary core 14 moves along the recess 12 provided in the upper surface of the core 11. The core 14 may move along a bore having a polygonal column shape provided substantially in the center of the core 11, providing the same effect.

The coil 13 is wound along the end 13B at an interval smaller than that at the other region. Alternatively, the coil 13 may have a region where a metal wire overlaps one over the other at the end 13B while the coil 13 is wound at the end 13B at an interval equal to that at the other region.

According to the embodiment, the core 11 and the auxiliary core 14 are made of ferrite magnetic materials, but may be made of rare earth metals, such as neodymium and samarium, having high magnetism.

The core 11 and the auxiliary core 14 may be made of plastic magnet, i.e., a mixture of plastic material and a powder of ferrite magnetic material.

What is claimed is:

1. An antenna comprising:

a first core made of first magnetic material;

a coil including a conductive wire having a portion wound around a predetermined region of the first core; and a second core made of second magnetic material, the second core being operable to move within an area between the portion of the conductive wire and the first core.

2. The antenna according to claim 1, wherein the first core has a recess provided therein, and wherein the second core is operable to move in the recess of the first core.

3. The antenna according to claim 1, wherein the coil has a first region and a second region where the conductive wire is wound at a density larger than a density of the conductive wire at the first region.

4. The antenna according to claim 3, wherein the second region of the coil is provided at an end of the coil.

5. The antenna according to claim 1, wherein the second magnetic material has a magnetic permeability larger than a magnetic permeability of the first magnetic material.

6. The antenna according to claim 1, wherein the second magnetic material comprises magnetic material of Mn ferrite.

7. The antenna according to claim 1, wherein the first magnetic material comprises magnetic material of Ni ferrite.

8. The antenna according to claim 1, wherein the first magnetic material comprises magnetic material of rare earth material.

9. The antenna according to claim 1, wherein the second magnetic material comprises magnetic material of rare earth material.

10. The antenna according to claim 1, wherein the first magnetic material and the second magnetic material are identical to each other.

11. A communication system comprising:

a first communication device;

an antenna connected to the first communication device, the antenna including a first core made of first magnetic material, a coil having a portion wound around a predetermined area of the first core, and a second core made of second magnetic material, the second core being operable to move within an area between the portion of the coil and the first core; and a second communication device operable to communicate with the first communication device via the antenna.

12. An antenna comprising:

a first core made of first magnetic material;

a coil including a conductive wire wound around a predetermined region of the first core; and a second core made of second magnetic material, the second core being operable to move inside of the coil, wherein the first core has a recess provided therein, and wherein the second core is operable to move in the recess of the first core.

13. The antenna according to claim 12, wherein the coil has a first region and a second region where the conductive wire is wound at a density larger than a density of the conductive wire at the first region.

14. The antenna according to claim 13, wherein the second region of the coil is provided at an end of the coil.

15. The antenna according to claim 12, wherein the second magnetic material has a magnetic permeability larger than a magnetic permeability of the first magnetic material.

16. The antenna according to claim 12, wherein the second magnetic material comprises magnetic material of Mn ferrite.

17. The antenna according to claim 12, wherein the first magnetic material comprises magnetic material of Ni ferrite.

18. The antenna according to claim 12, wherein the first magnetic material comprises magnetic material of rare earth material.

19. The antenna according to claim 12, wherein the second magnetic material comprises magnetic material of rare earth material.

20. The antenna according to claim 12, wherein the first magnetic material and the second magnetic material are identical to each other.

21. A communication system comprising:

a first communication device;

an antenna connected to the first communication device, the antenna including a first core made of first magnetic material, a coil including a conductive wire wound around a predetermined region of the first core, and a second core made of second magnetic material, the second core being operable to move inside of the coil, wherein the first core has a recess provided therein, and wherein the second core is operable to move in the recess of the first core; and a second communication device operable to communicate with the first communication device via the antenna.

22. An antenna comprising:

a first core made of first magnetic material;

a coil including a conductive wire wound around a predetermined region of the first core; and a second core made of second magnetic material, the second core being operable to move inside of the coil, wherein the coil has a first region and a second region where the conductive wire is wound at a density larger than a density of the conductive wire at the first region.

23. The antenna according to claim 22, wherein the second region of the coil is provided at an end of the coil.

24. The antenna according to claim 22, wherein the second magnetic material has a magnetic permeability larger than a magnetic permeability of the first magnetic material.

25. The antenna according to claim 22, wherein the second magnetic material comprises magnetic material of Mn ferrite.

26. The antenna according to claim 22, wherein the first magnetic material comprises magnetic material of Ni ferrite.

27. The antenna according to claim 22, wherein the first magnetic material comprises magnetic material of rare earth material.

28. The antenna according to claim 22, wherein the second magnetic material comprises magnetic material of rare earth material.

29. The antenna according to claim 22, wherein the first magnetic material and the second magnetic material are identical to each other.

30. A communication system comprising:

a first communication device;

an antenna connected to the first communication device, the antenna including a first core made of first magnetic material, a coil including a conductive wire wound around a predetermined region of the first core, and a second core made of second magnetic material, the second core being operable to move inside of the coil, wherein the coil has a first region and a second region where the conductive wire is wound at a density larger than a density of the conductive wire at the first region; and a second communication device operable to communicate with the first communication device via the antenna.

* * * * *